US007890045B2

(12) United States Patent
Wasai

(10) Patent No.: US 7,890,045 B2
(45) Date of Patent: Feb. 15, 2011

(54) WASTE TONER RECOVERING MECHANISM AND IMAGE FORMING APPARATUS

(75) Inventor: Akihiro Wasai, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 186 days.

(21) Appl. No.: 12/365,095

(22) Filed: Feb. 3, 2009

(65) Prior Publication Data

US 2009/0196666 A1 Aug. 6, 2009

Related U.S. Application Data

(60) Provisional application No. 61/026,098, filed on Feb. 4, 2008.

(51) Int. Cl.
*G03G 21/12* (2006.01)

(52) U.S. Cl. ..... 399/360

(58) Field of Classification Search ..... 399/360, 399/358, 257, 120

See application file for complete search history.

(56) References Cited

U.S. PATENT DOCUMENTS 5,697,701 A * 12/1997 Forrest et al.

2007/0292179 A1* 12/2007 Kudo ..... 399/358

FOREIGN PATENT DOCUMENTS

JP PH07-319351 12/1995
JP P2007-127845 5/2007

* cited by examiner

*Primary Examiner*—Suasn S Lee
(74) *Attorney, Agent, or Firm*—Patterson & Sheridan, LLP

(57) ABSTRACT

A technique is provided which allows an agitation paddle, which flattens waste toner in a waste toner container, to rotate at a sufficiently low rotation speed and contributing to a decrease in cost with the saving of space and a simple configuration. A waste toner recovering mechanism includes a first rotating member, a second rotating member, a linking member, and a one-way clutch which is disposed between an agitation paddle and the second rotating member and which transmits only a rotational driving force from the second rotating member rotating in a first rotation direction to the agitation paddle. Here, the support positions of the linking member relative to the first and second rotating members and the length of the linking member are set so that a rotation angle range of the second rotating member while the first rotating member rotates in one turn is narrower than 180°.

17 Claims, 12 Drawing Sheets

FIG. 6

| | | | |
|---|---|---|---|
| L (cm) | 15 | 12 | 10 |
| r 2 (cm) | 6 | 7 | 5 |
| r 1 (cm) | 3 | 2 | 1 |
| | | | |
| m (cm) | 15.87451 | 13.74773 | 11.13553 |
| θ (°) | 31.94806 | 19.10661 | 12.86829 |

WASTE TONER RECOVERING MECHANISM AND IMAGE FORMING APPARATUS

CROSS-REFERENCE TO RELATED APPLICATION

This application is based upon and claims the benefit of priority from:

U.S. provisional application 61/026,098, filed on Feb. 4, 2008, the entire contents of which is incorporated herein by reference.

TECHNICAL FIELD

The present invention relates to a technique of driving an agitation paddle flattening waste toner in a waste toner container.

BACKGROUND

In an image forming apparatus for developing an electrostatic latent image formed on a photoconductive member with toner, a waste toner recovering mechanism guiding and recovering unnecessary toner remaining on the photoconductive member into a waste toner container through a predetermined toner carrying path was known in the past.

In the known image forming apparatus having the waste toner recovering mechanism, it was detected by a transmissive sensor whether the toner guided and accumulated into the waste toner container with the usage of the image forming apparatus reaches its allowable limit of the waste toner container.

Generally, in the waste toner recovering mechanism, the erroneous detection of the sensor was prevented by agitating and flattening the waste toner locally lifted off and accumulated in the waste toner container by the use of an agitation paddle.

Configurations of (1) using a motor dedicated to the agitation paddle and (2) using motors-used for other driving sections to drive the agitation paddle could be employed to the agitation paddle to periodically rotate.

However, in the configuration of (1), there is a problem with cost required for installing the dedicated motor. In the configuration of (2), it is necessary to switch the transmission of power to driven sections from the motor by the use of a clutch or the like, thereby complicating a power transmitting mechanism. The installation of the complicated power transmitting mechanism could hinder the saving of space.

When the agitation paddle is made to always rotate, it is preferable that the agitation paddle is made to rotate as at a low speed as possible so as to prevent the contamination or the erroneous detection of the sensor due to the flying waste toner. However, the employment of a gear train or a belt as a reduction gear mechanism complicates the power transmitting mechanism.

SUMMARY

An advantage of some aspects of the invention is that it provides a technique for allowing an agitation paddle, which flattens waste toner in a waste toner container, to rotate at a sufficiently low rotation speed and contributing to a decrease in cost with the saving of space and a simple configuration.

According to an aspect of the invention, there is provided a waste toner recovering mechanism including: a first rotating member rotating about a first rotation shaft with a rotational driving force; a second rotating member rotating about a second rotation shaft parallel to the first rotation shaft; a linking member of which one end is rotatably supported at a position, which is decentered from the first rotation shaft, in the first rotating member and of which the other end is rotatably supported at a position, which is decentered from the second rotation shaft, in the second rotating member; and a one-way clutch which is disposed between an agitation paddle agitating waste toner recovered into a waste toner container and the second rotating member and which transmits a rotational driving force from the second rotating member rotating in a first rotation direction to the agitation paddle but does not transmit the rotational driving force from the second rotating member rotating in a second rotation direction opposite to the first rotation direction to the agitation paddle. Here, the support positions of the linking member in the first and second rotating members and the length of the linking member are set so that a rotation angle range of the second rotating member while the first rotating member rotates in one turn is narrower than 180°.

According to another aspect of the invention, there is provided an image forming apparatus including: a rotational driving source; a first rotating member rotating about a first rotation shaft with a rotational driving force from the rotational driving source; a second rotating member rotating about a second rotation shaft parallel to the first rotation shaft; a linking member of which one end is rotatably supported at a position, which is decentered from the first rotation shaft, in the first rotating member and of which the other end is rotatably supported at a position, which is decentered from the second rotation shaft, in the second rotating member; a waste toner container containing waste toner; an agitation paddle agitating the waste toner recovered into the waste toner container; and a one-way clutch which is disposed between the agitation paddle and the second rotating member and which transmits a rotational driving force from the second rotating member rotating in a first rotation direction to the agitation paddle but does not transmit the rotational driving force from the second rotating member rotating in a second rotation direction opposite to the first rotation direction to the agitation paddle. Here, the support positions of the linking member in the first and second rotating members and the length of the linking member are set so that a rotation angle range of the second rotating member while the first rotating member rotates in one turn is narrower than 180°.

DESCRIPTION OF THE DRAWINGS

FIG. 6 is a table illustrating relations of distance L (cm), distance $r_1$ (cm), distance $r_2$ (cm), and distance m (cm) and the rotation angle range θ (°) of the second rotating member.

DETAILED DESCRIPTION

Hereinafter, embodiments of the invention will be described with reference to the accompanying drawings.

First Embodiment

A first embodiment of the invention will be described now.

Figure 1:
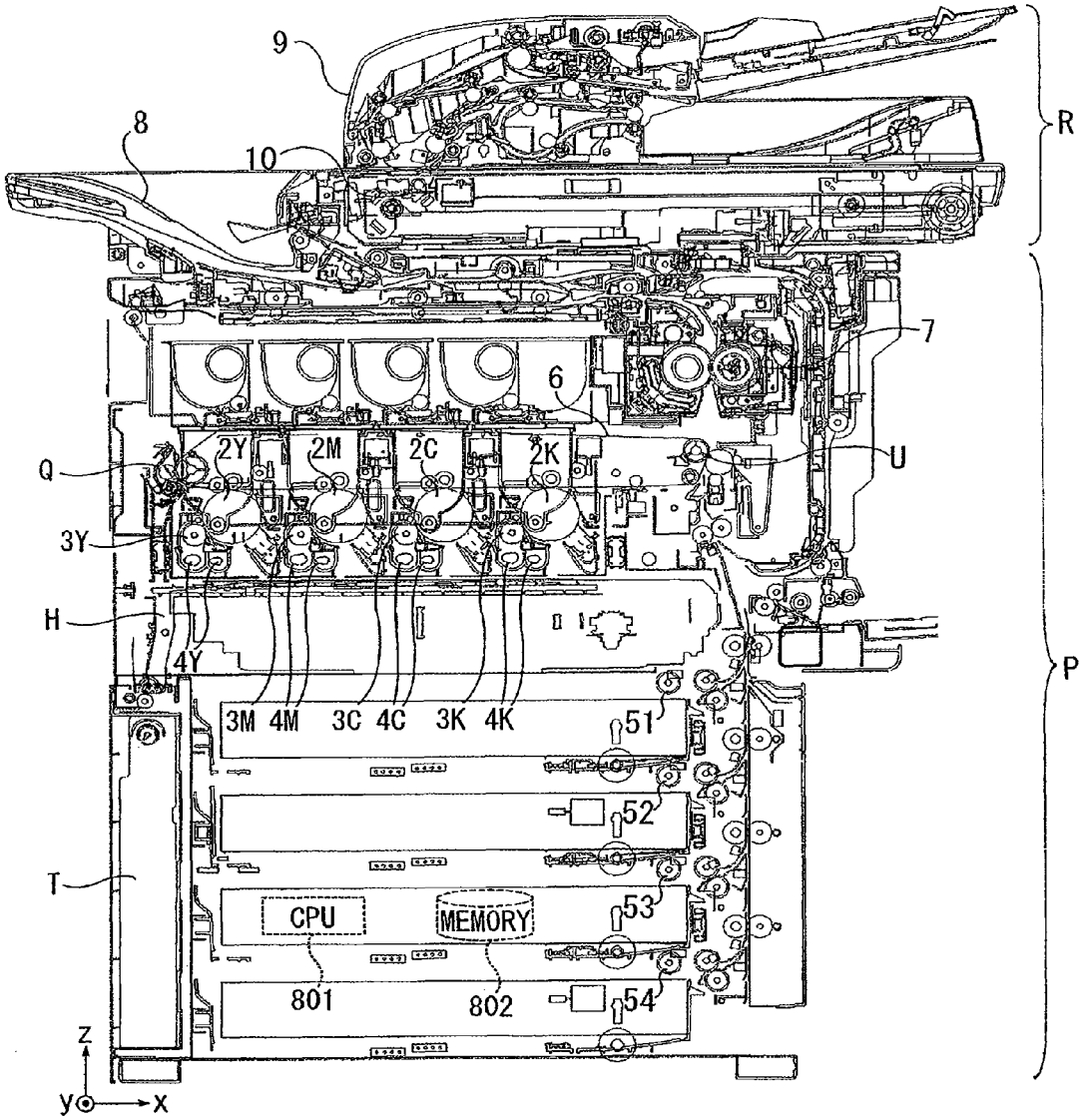
FIG. 1 is a longitudinal sectional view schematically illustrating a configuration of an image forming apparatus according to a first embodiment of the invention.

FIG. 1 is a longitudinal sectional view schematically illustrating a configuration of an image forming apparatus (MFP: Multi Function Peripheral) according to the first embodiment of the invention.

As shown, in FIG. 1, the image forming apparatus according to this embodiment includes an image reading unit R and an image forming unit P.

The image reading unit R has a function of scanning and reading images of original document sheets and an original document book.

The image forming unit P has a function of forming a developer image on a sheet on the basis of the images read from the original document by the image reading unit R or image data transmitted from an external device to the image forming apparatus.

The image reading unit R has an auto document feeder (ADF) 9 automatically carrying an original document to a predetermined image reading position and reads images of an original document automatically carried by the ADF 9 or an original document placed on an original document base by the use of a scanning optical system 10.

The image forming unit P includes pickup rollers 51 to 54, photoconductive members 2Y to 2K, developing rollers 3Y to 3K, mixers 4Y to 4K, an intermediate transfer belt 6, a fixing device 7, and a sheet discharging tray 8.

A copying process will be described now as an exemplary process of the image forming apparatus according to this embodiment.

First, a sheet picked up from a cassette by the pickup rollers 51 to 54 is fed to a sheet carrying path. The sheet fed to the sheet carrying path is carried in a predetermined carrying direction by plural roller pairs.

Images of plural sheets of original document automatically continuously carried by the ADF 9 are read at a predetermined image reading position by the scanning optical system 10.

Electrostatic latent images are formed on photoconductive surfaces of the photoconductive members 2Y, 2M, 2C, and 2K transferring developer images of yellow (Y), magenta (M), cyan (C), and black (K) on a sheet on the basis of image data of the images read from the original document by the image reading unit R.

Then, developer agitated by the mixers 4Y to 4K (corresponding to the agitation member) in the developing device is supplied to the photoconductive members 2Y to 2K having the electrostatic latent images formed thereon as described above by the developing rollers (so-called magnet rollers) 3Y to 3K. Accordingly, the electrostatic latent images formed on the photoconductive surfaces of the photoconductive members are developed.

The developer images formed on the photoconductive members in this way are transferred onto a belt surface of the intermediate transfer belt 6 (so-called primary transfer) and the developer images carried with the rotation of the intermediate transfer belt are transferred onto the carried sheets at a predetermined secondary transfer position U.

The developer images transferred onto the sheets are heated and fixed to the sheet by the fixing device 7.

The sheets to which the developer images are heated and fixed are carried along the carrying path by plural carrying roller pairs and are sequentially discharged onto the sheet discharging tray 8.

The image forming apparatus according to this embodiment removes unnecessary toner (waste toner) remaining on or attached to the belt surface of the intermediate transfer belt 6 from the belt surface of the intermediate transfer belt 6 by the use of a cleaner Q and carries the waste toner to a waste toner recovering mechanism T through a waste toner carrying path H.

Specifically, the image forming apparatus according to this embodiment includes a rotational driving source not shown, a waste toner recovering mechanism T, a waste toner container 104, and an agitation paddle 107.

The waste toner container 104 serves as a container containing the waste toner guided along the waste toner carrying path H.

The agitation paddle 107 is disposed in the waste toner container 104. The agitation paddle 107 serves to agitate the waste toner recovered in the waste toner container 104. The waste toner container 104 can be attached to and detached from the image forming apparatus along with the agitation paddle 107 disposed therein.

The waste toner recovering mechanism T includes a carrying member 106, a power transmitting shaft 105, a first rotating member 101, a second rotating member 102, a linking member 103, and a one-way clutch 102*w*.

Figure 2:
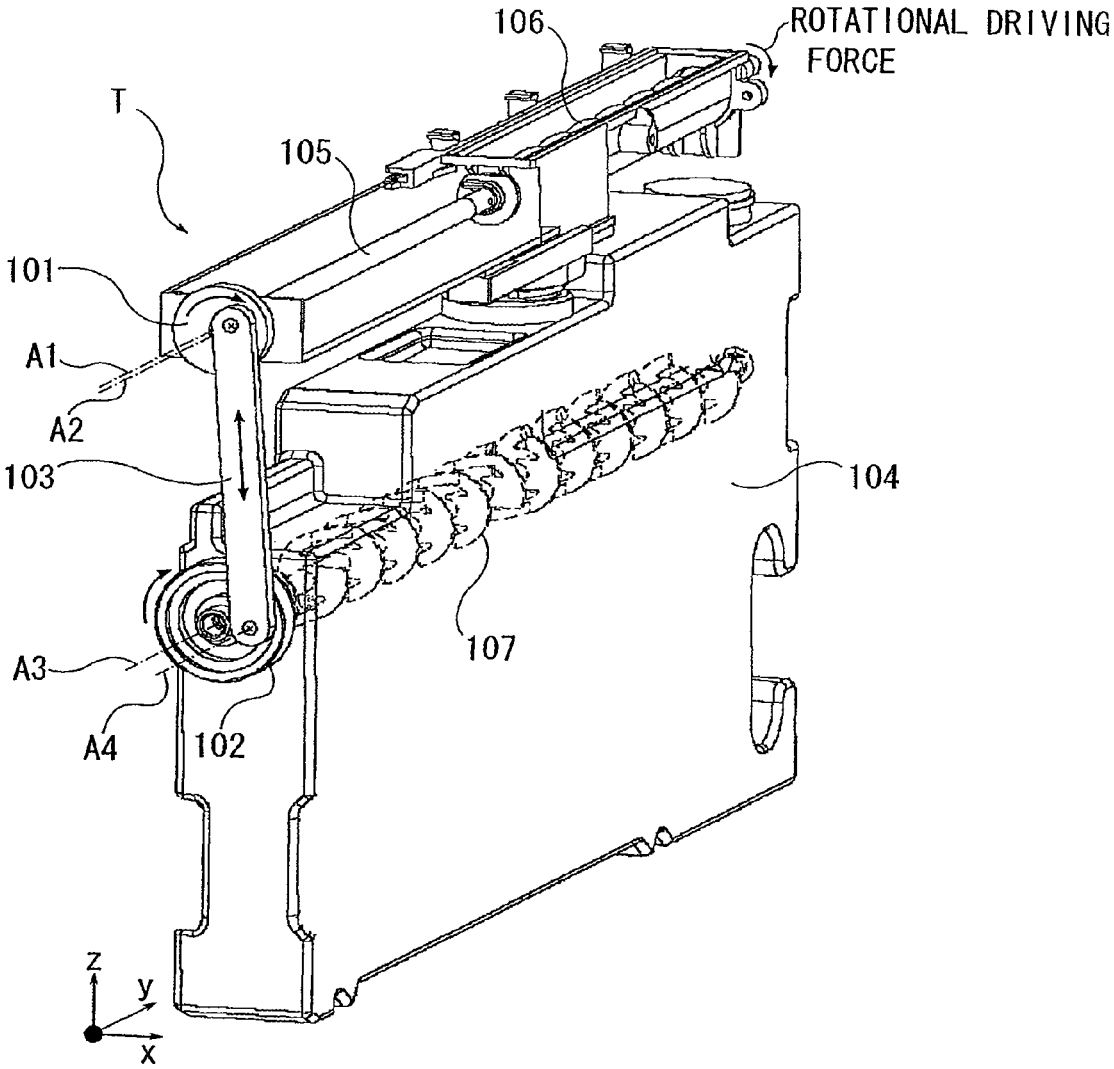
FIG. 2 is a perspective view illustrating a configuration of a waste toner recovering mechanism according to the first embodiment of the invention.
Figure 3:
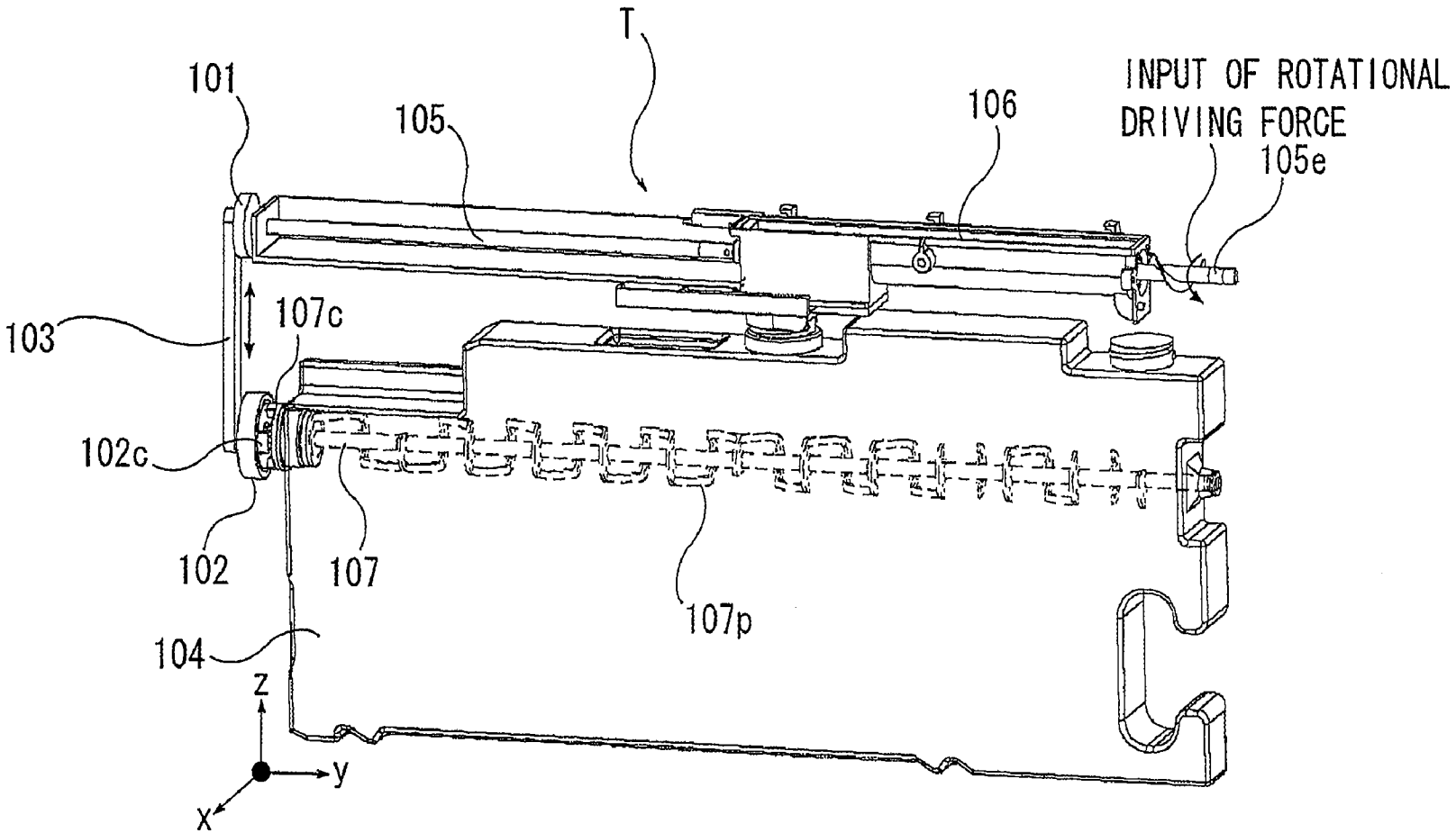
FIG. 3 is a perspective view illustrating a configuration of the waste toner recovering mechanism according to the first embodiment of the invention.

The constituent elements of the waste toner recovering mechanism T according to this embodiment will be described in detail now. FIGS. 2 and 3 are perspective views illustrating a configuration of the waste toner recovering mechanism according to the first embodiment of the invention.

The carrying member 106 carries the waste toner guided to the waste toner container 104 along the waste toner carrying path H into the waste toner container 104. Specifically, the carrying member 106 is formed by, for example, an auger.

The first rotating member 101 is supplied with a rotation driving force (see FIG. 2) from the rotational driving source through the carrying member 106 and the power transmitting shaft 105 and is rotationally driven about a first rotation shaft A1.

The first rotating member 101 is connected to the carrying member 106 carrying the waste toner into the waste toner container 104 through the power transmitting shaft 105 and rotates in a bundle with the carrying member 106 with the rotation of the carrying member 106.

The second rotating member 102 rotates about a second rotation shaft A3 parallel to the first rotation shaft A1. The second rotation shaft A3 coincides with the rotation center of the agitation paddle 107 disposed in the waste toner container 104.

One end of the linking member 103 is rotatably supported at a position (position of a rotation shaft A2), which is decentered from the first rotation shaft A1, in the first rotating member 101 and the other end thereof is rotatably supported at a position (position of a rotation shaft A4), which is decentered from the second rotation shaft A3, in the second rotating member 102.

The one-way clutch 102*w* is disposed between the agitation paddle 107 and the second rotating member 102. Specifically, the one-way clutch 102*w* serves to transmit the rotation driving force from the second rotating member 102 rotating in a first rotation direction (for example, the rotation direction of the second rotating member 102 indicated by an arrow in FIG. 2) to the agitation paddle 107 but not to transmit the rotational driving force from the second rotating member 102 rotating in a second rotation direction opposite to the first rotation direction to the agitation paddle 107.

Figure 4:
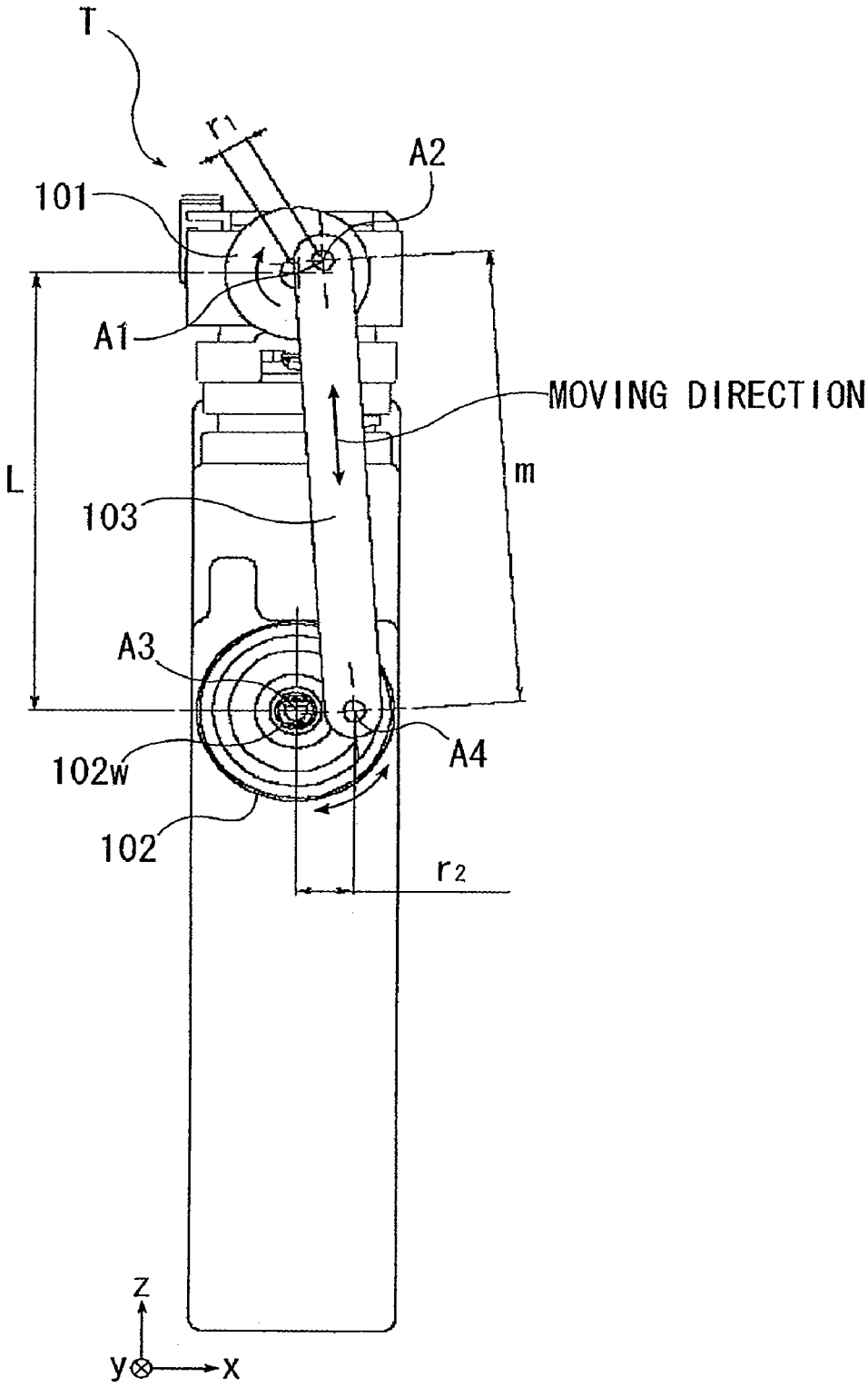
FIG. 4 is a diagram illustrating size relations of constituent members of the waste toner recovering mechanism according to the first embodiment of the invention.
Figure 5:
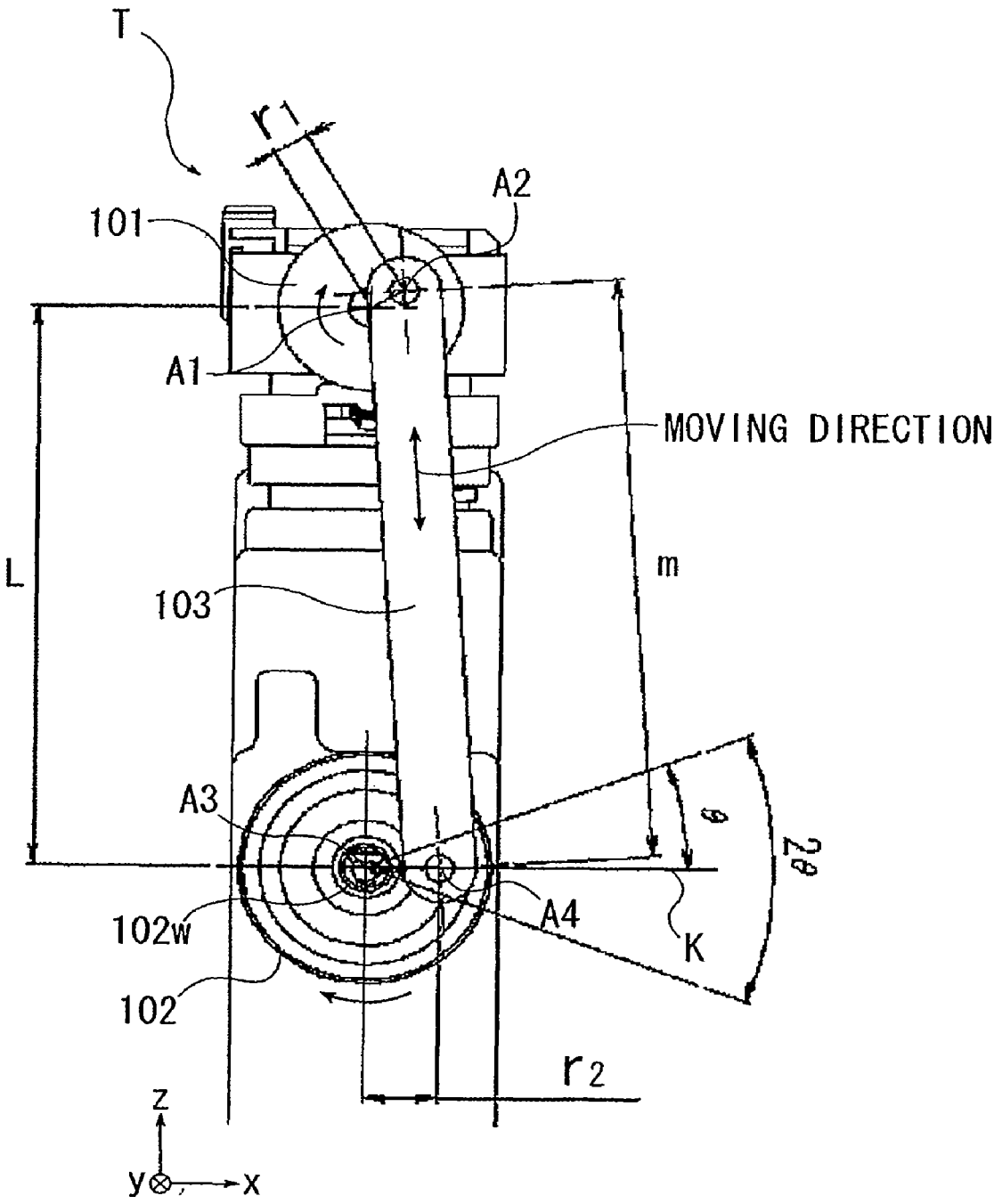
FIG. 5 is a diagram illustrating a rotation angle range (a range of deflection angle) of a second rotating member in the waste toner recovering mechanism according to the first embodiment of the invention.

Position and size relations of the first rotating member 101, the second rotating member 102, and the linking member 103 in this embodiment will be described in detail now. FIG. 4 is a diagram illustrating size relations of the members of the waste toner recovering mechanism according to the first embodiment of the invention. FIG. 5 is a diagram illustrating a rotation angle range (range of deflection angle) of the second rotating member 102 in the waste toner recovering mechanism according to the first embodiment of the invention.

Here, when it is assumed that L represents a distance between the first rotation shaft A1 and the second rotation shaft A3, $r_1$ represents a distance between the support shaft of one end of the linking member in the first rotating member and the first rotation shaft, $r_2$ represents a distance between the support shaft of the other end of the linking member in the second rotating member and the second rotation shaft, and m represents a distance between the support shaft position of one end of the linking member and the support shaft position of the other end, conditional relations $L+r_1-r_2<m<L+r_2-r_1$ and $r_1<r_2$ are satisfied.

In this embodiment, by setting the support positions (of the rotation shafts A2 and A4) of the linking member 103 relative to the first rotating member 101 and the second rotating member 102 and the length of the linking member 103 as described above, the rotation angle range of the second rotating member 102 while the first rotating member 101 rotates in one turn is narrower than 180°.

FIG. 6 is a table illustrating relations of the distance L (cm), the distance $r_1$ (cm), the distance $r_2$ (cm), and the distance m (cm) and the rotation angle range θ (°) of the second rotating member.

Operations of the second rotating member 102 and the linking member 103 relative to the first rotating member 101 in this embodiment will be described in detail now.

FIGS. 7 to 10 are diagrams illustrating motions of the linking member 103 and the second rotating member 102 with the rotational motion of the first rotating member 101.

Figure 7:
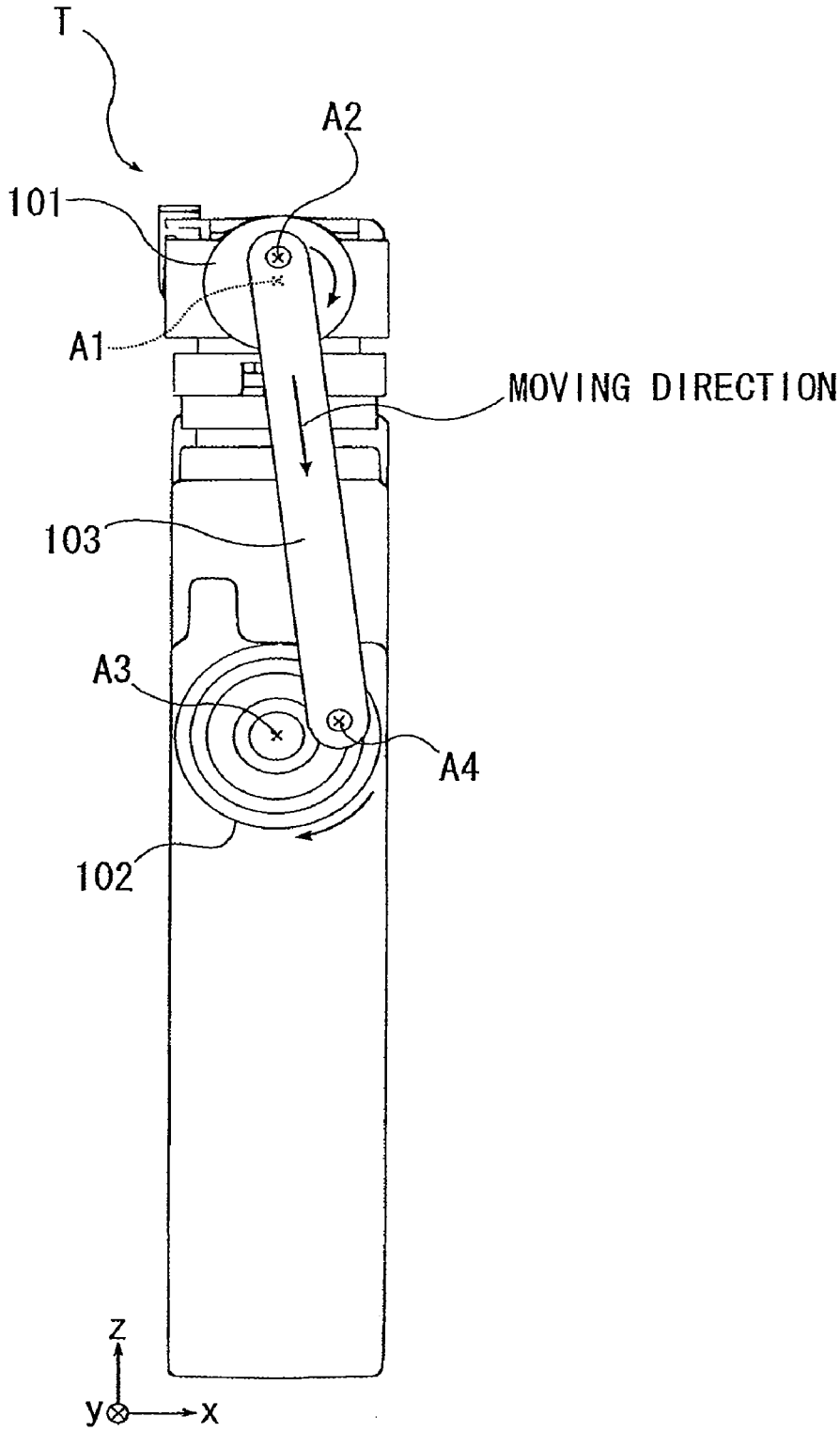
FIG. 7 is a diagram illustrating a motion of a linking member with a rotational motion of a first rotating member.

FIG. 7 shows a state where the first rotating member 101 is located at an angle where the support shaft A2 of one end of the linking member 103 reaches the highest point.

In this state, when the first rotating member 101 rotates with the rotational driving force supplied from the rotational driving source through the carrying member 106, the linking member 103 moves downward (see FIG. 7).

Figure 8:
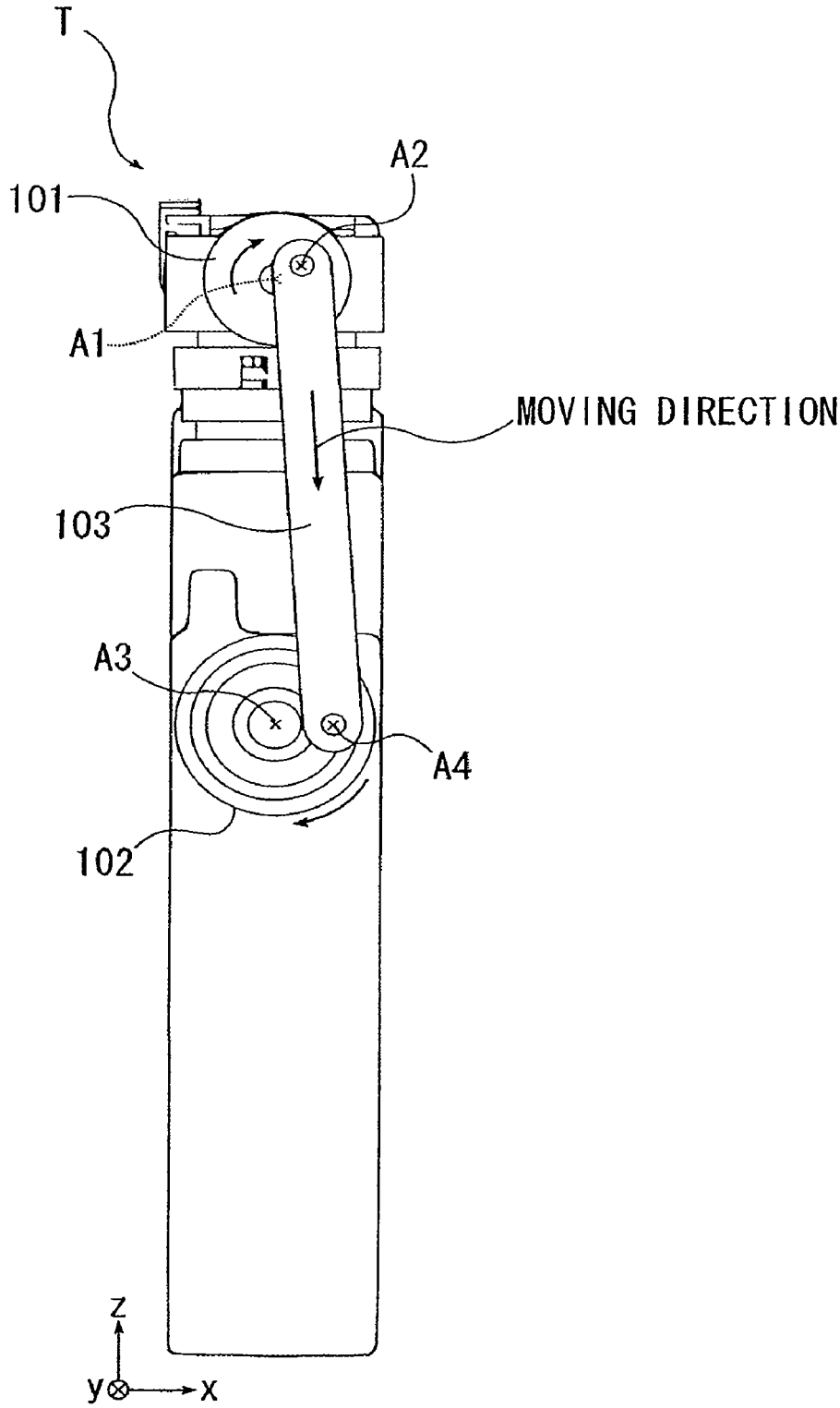
FIG. 8 is a diagram illustrating the motion of the linking member with the rotational motion of the first rotating member.
Figure 9:
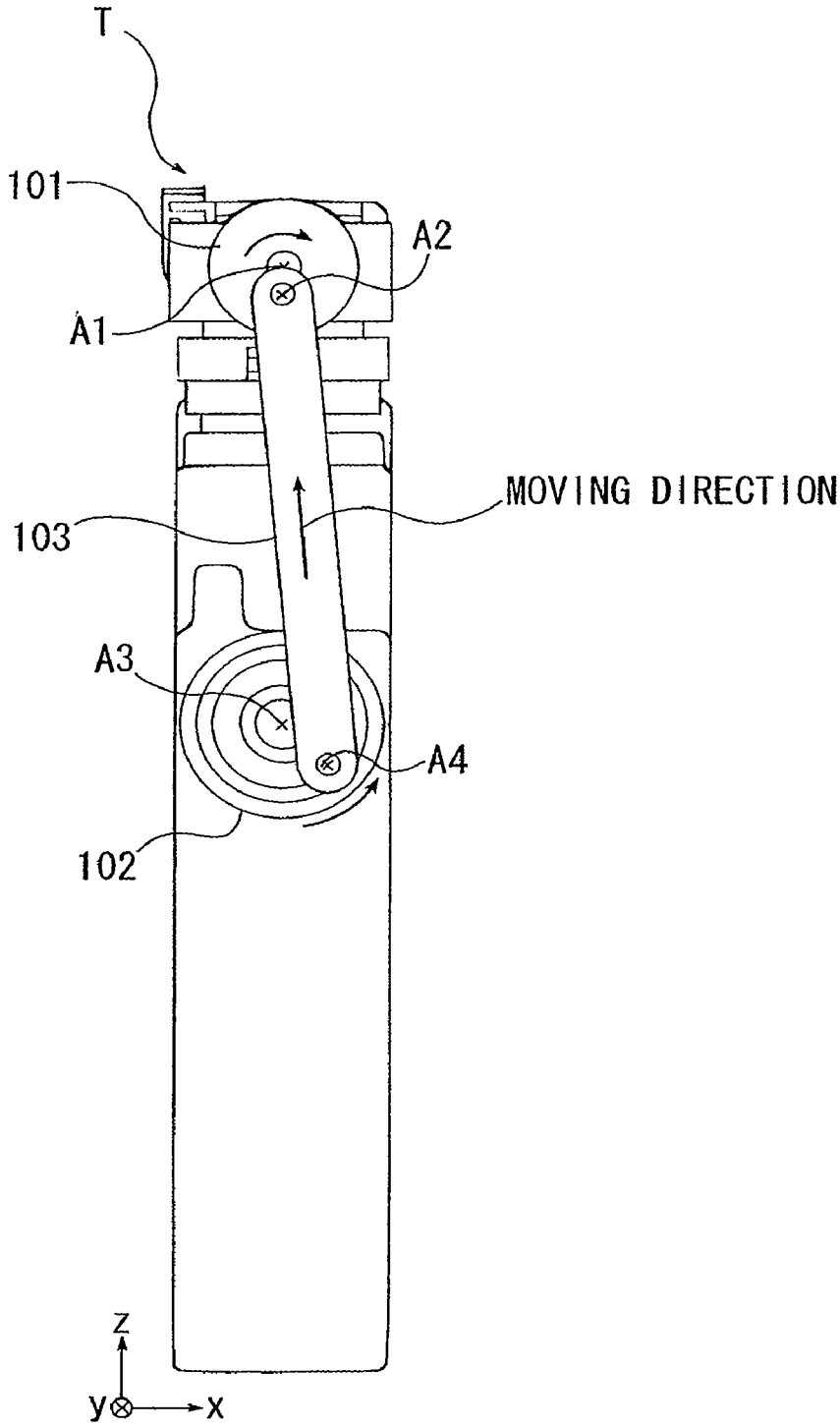
FIG. 9 is a diagram illustrating the motion of the linking member with the rotational motion of the first rotating member.
Figure 10:
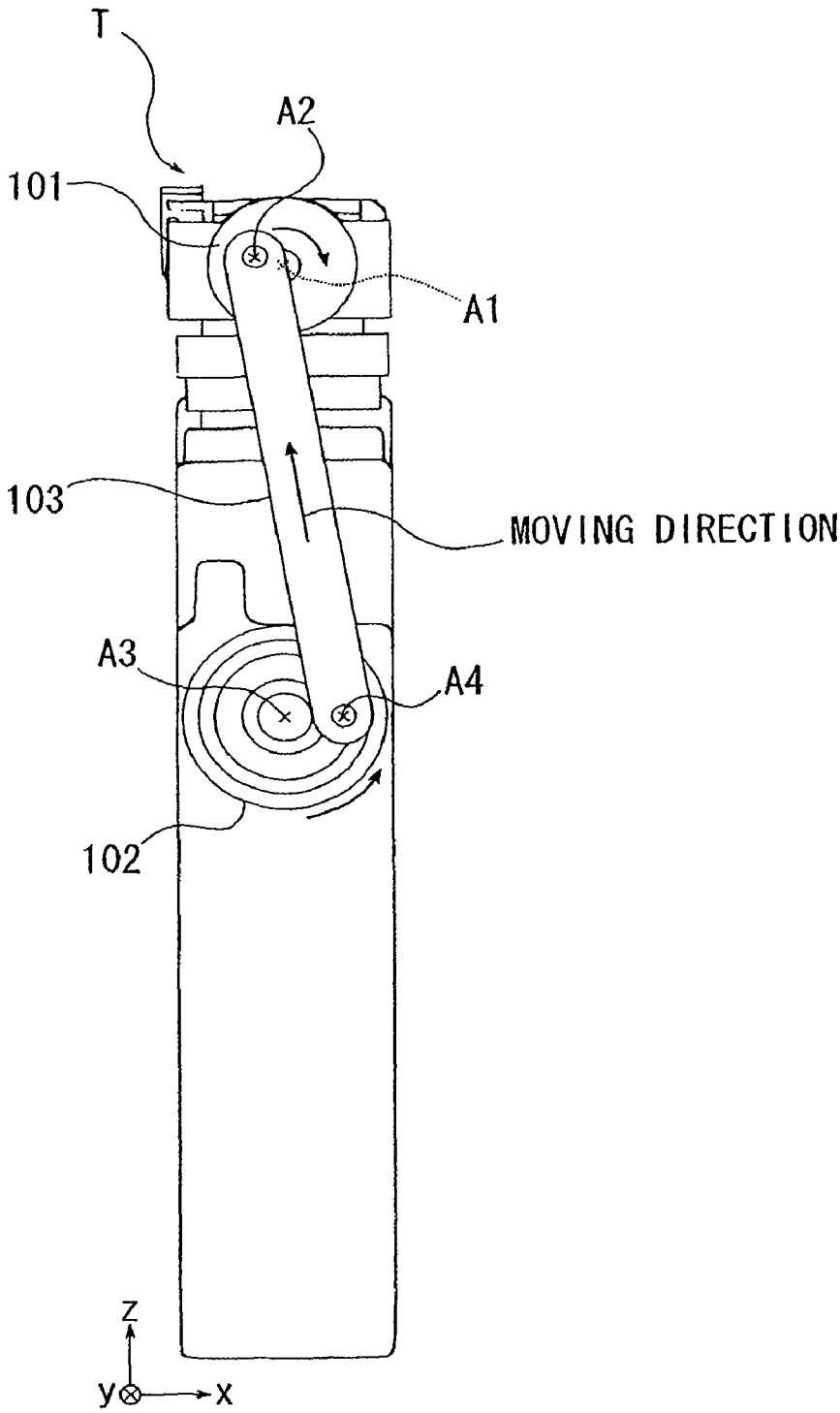
FIG. 10 is a diagram illustrating the motion of the linking member with the rotational motion of the first rotating member.

Then, when the linking member reaches the position shown in FIG. 9 via the state shown in FIG. 8 with the rotation of the first rotating member 101, the linking member 103 starts its upward movement (see FIG. 9).

Then, the linking member 103 rises up and returns to the state shown in FIG. 7. Thereafter, the linking member 103 repeats the series of operations shown in FIGS. 7 to 9.

As can be seen from FIGS. 7 to 9, when the first rotating member 101 is rotating in one turn (rotation of 360°) with the rotational driving force, the second rotating member 102 rotationally reciprocates with the deflection width of a predetermined angle range.

Here, the second rotating member 102 and the agitation paddle 107 are connected to each other through the one-way clutch 102*w* and the rotational driving force from the first rotating member 101 is transmitted to the agitation paddle 107 only when the second rotating member 102 rotates in a predetermined rotation direction.

Accordingly, when the linking member 103 operates (reciprocates) as shown in FIGS. 7 to 9 and the linking member 103 is in only one of a forward path and a backward path, the agitation paddle 107 rotates. When the linking member 103 is in the other of the forward path and the backward path, the agitation paddle 107 does not rotate.

The one-way clutch 102*w* and the agitation paddle 107 are detachably coupled to each other by a first connecting member 102*c* disposed close to the one-way clutch 102*w* and a second connecting member 107*c* disposed close to the agitation paddle 107. Here, the first connecting member 102*c* and the second connecting member 107*c* correspond to the connecting portion in the claims.

As can be seen from FIGS. 5 and 6, in this embodiment, a straight line passing through the second rotation shaft A3 and being perpendicular to the straight line connecting the first rotation shaft A1 and the second rotation shaft A3 is set to be located at the center of the range of deflection angle (2θ) of the straight line K (see FIG. 5) connecting the support shaft A4 of the other end of the linking member 103 in the second rotating member 102 to the second rotation shaft A3.

Specifically, in order to allow the second rotating member 102 to rotationally reciprocate in the above-mentioned angle range, the size or position relations of the first rotating member 101, the second rotating member 102, and the linking member 103 need to satisfy the following conditions:

$$m=L^2+r_2^2-r_1^2;\text{ and} \tag{1}$$

$$\theta=\sin^{-1}((r_1\times(m)^{1/2})/(r_2\times L)). \tag{2}$$

According to this configuration, the operation range of the first rotating member 101, the second rotating member 102, and the linking member 103 can be set into a narrow space, thereby realizing a great reduction ratio.

In enhancing the reduction ratio, how to set $r_1$ and $r_2$ need be considered. Specifically, by satisfying the following conditions (1) and (2), the greater reduction ratio can be realized.

(1) To decrease $r_1$ (2) To increase $r_2$

Therefore, in this embodiment, the support shaft A2 of one end of the linking member 103 in the first rotating member 101 is located at a position more inside in a radial direction of rotation of the first rotating member 101 than the center position of a range from the first rotation shaft A1 to the circumferential edge thereof in the radial direction of rotation.

In addition, the support shaft A4 of the other end of the linking member 103 in the second rotating member 102 is located at a position more outside in a radial direction of rotation of the second rotating member 102 than the center position of a range from the second rotation shaft A3 to the circumferential edge thereof in the radial direction of rotation.

According to this configuration, the rotational driving force input to the first rotating member 101 with a certain number of rotations can be transmitted to the agitation paddle with the number of rotations greatly reduced (for example, 1/10 of the number of rotations) with a configuration capable of saving a space.

Second Embodiment

A second embodiment of the invention will be described now.

The second embodiment of the invention is a modified example of the above-mentioned first embodiment. The second embodiment is different from the first embodiment, in a configuration capable of detecting the number of rotations of the agitation paddle.

Hereinafter, elements having the same functions as described in the first embodiment are referenced by the same reference numerals and description thereof is omitted.

Specifically, the image forming apparatus having a driving force transmitting mechanism according to the second embodiment of the invention includes an optical sensor S turned on and off by the movement of the linking member 103 with the rotation of the first rotating member 101.

Figure 11:
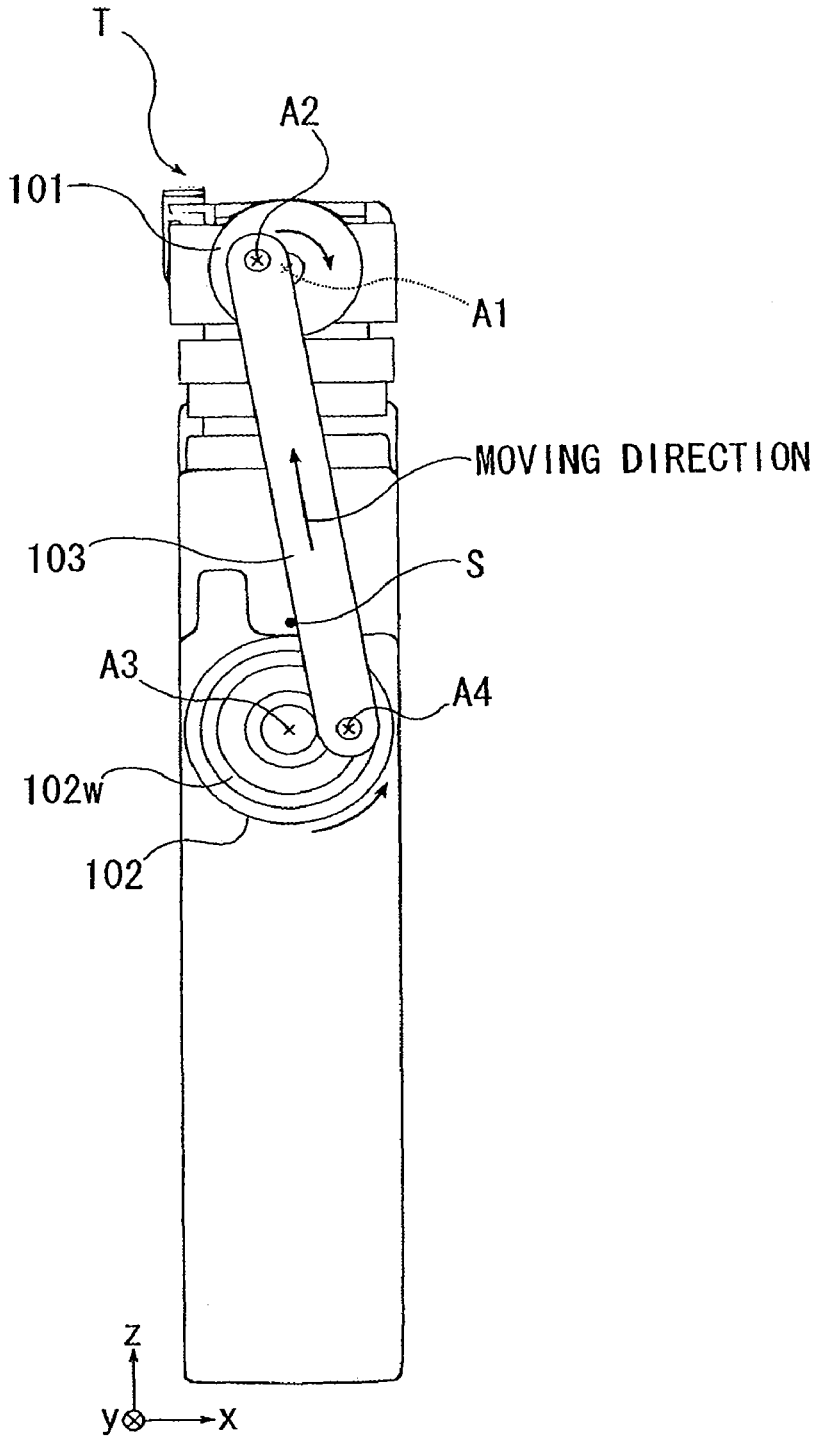
FIG. 11 is a diagram illustrating a state where the linking member is not detected by an optical sensor S.
Figure 12:
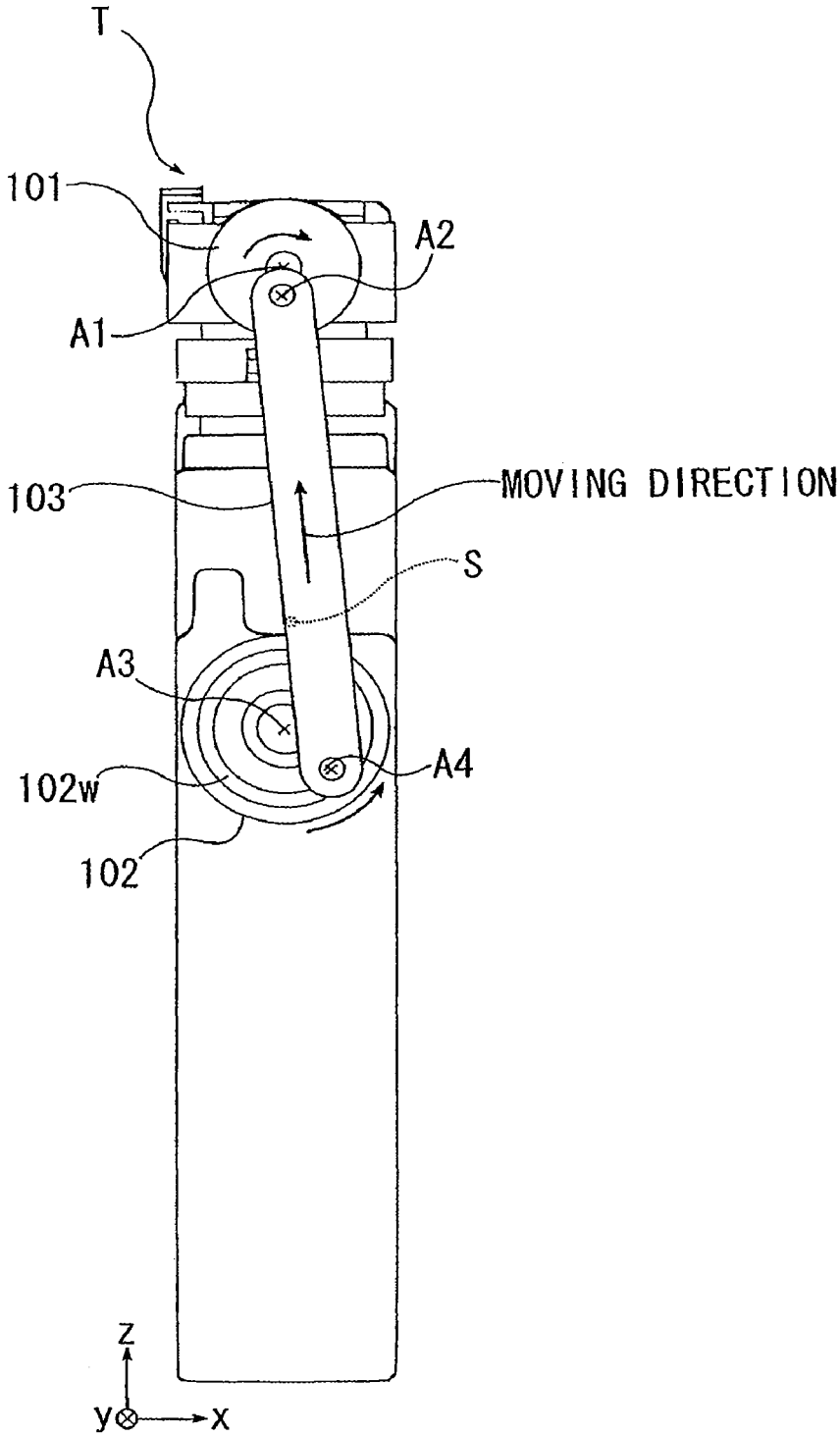
FIG. 12 is a diagram illustrating a state where the linking member is detected by an optical sensor S.

FIG. 11 is a diagram illustrating a state where the linking member 103 is not detected by the optical sensor S. FIG. 12 is a diagram illustrating a state where the linking member 103 is detected by the optical sensor S.

By disposing the optical sensor S in this way, it is possible to accurately grasp the numbers of rotations of the first rotating member 101, the second rotating member 102, and the agitation paddle 107.

Specifically, detection information (here, detection timing) of the optical sensor S is acquired by a CPU 801 and the number of rotations of the carrying member 106 is counted whenever the CPU 801 receives the output of the optical sensor S. Of course, it is also possible to grasp by what turns the agitation member 107 rotates on the basis of the rotation angle of the second rotating member 102 when the first rotating member 101 rotates by one turn, in addition to the carrying member 106.

In this embodiment, it is exemplified that the movement of the linking member 103 is detected by the optical sensor. However, any sensor can be employed so long as it can conclusively detect the movement of the linking member 103. For example, a contact switch type sensor may be employed. Any scheme of the optical sensor can be employed so long as it can conclusively detect the passage of the linking member 103. For example, any of a transmissive scheme and a reflective scheme may be employed.

Third Embodiment

A third embodiment of the invention will be described now.

The third embodiment of the invention is a modified example of the above-mentioned embodiments. The third embodiment is different from the above-mentioned embodiments, in arrangement of the one-way clutch.

Hereinafter, elements having the same functions as described in the above-mentioned embodiment are referenced by the same reference numerals and description thereof is omitted.

In the above-mentioned embodiments, the configuration is exemplified in which the one-way clutch disposed between the agitation paddle and the second rotating member is connected to the second rotating member and the agitation paddle is coupled to the one-way clutch, but the invention is not limited to the configuration.

In the image forming apparatus according to this embodiment, the one-way clutch disposed between the agitation paddle and the second rotating member is connected to the agitation paddle and the second rotating member is coupled to the one-way clutch.

In the above-mentioned embodiments, the configuration is exemplified in which a motor for rotationally driving the carrying member carrying the waste toner into the waste toner container is used as the rotational driving source for rotationally driving the first rotating member, but the invention is not limited to the configuration.

That is, any configuration can be employed as the rotational driving source according to the invention, so long as it can conclusively rotationally drive the first rotating member.

It is preferable in view of the saving of space and the decrease in cost that a driving source used for other driving sections, such as (1) a motor rotationally driving a photoconductive drum, (2) a motor rotationally driving an intermediate transfer belt unit (TBU), (3) a motor rotationally driving a primary transfer roller, and (4) a motor rotationally driving a secondary transfer roller, is used as the rotation driving source.

According to the above-mentioned embodiments, it is possible to embody the driving force transmission at a reduction ratio (for example, a ratio of 1:10 or higher), which generally requires employing a gear train including several stages of gears or a belt transmission mechanism, with the mechanism having a high space efficiency and a simple configuration.

Although the invention is described above with reference to the specific embodiments, it will be apparent to those skilled in the art that the invention can be modified in various forms without departing from the spirit and scope of the invention.

As described in detail above, according to the invention, it is possible to provide a technique for allowing an agitation paddle, which flattens waste toner in a waste toner container, to rotate at a sufficiently low rotation speed and contributing to a decrease in cost with the saving of space and a simple configuration.

What is claimed is:

1. A waste toner recovering mechanism comprising:

a first rotating member rotating about a first rotation shaft with a rotational driving force;

a second rotating member rotating about a second rotation shaft parallel to the first rotation shaft;

a linking member of which one end is rotatably supported at a position, which is decentered from the first rotation shaft, in the first rotating member and of which the other end is rotatably supported at a position, which is decentered from the second rotation shaft, in the second rotating member; and a one-way clutch which is disposed between an agitation paddle agitating waste toner recovered into a waste toner container and the second rotating member and which transmits a rotational driving force from the second rotating member rotating in a first rotation direction to the agitation paddle but does not transmit the rotational driving force from the second rotating member rotating in a second rotation direction opposite to the first rotation direction to the agitation paddle, wherein the support positions of the linking member relative to the first and second rotating members and the length of the linking member are set so that a rotation angle range of the second rotating member while the first rotating member rotates in one turn is narrower than 180°.

2. The mechanism according to claim 1, wherein conditional relations $L+r_1-r_2<m<L+r_2-r_1$ and $r_1<r_2$ are satisfied, where L represents a distance between the first rotation shaft and the second rotation shaft, $r_1$ represents a distance between the support shaft of one end of the linking member in the first rotating member and the first rotation shaft, $r_2$ represents a distance between the support shaft of the other end of the linking member in the second rotating member and the second rotation shaft, and m represents a distance between the support shaft position of one end of the linking member and the support shaft position of the other end.

3. The mechanism according to claim 1, wherein a straight line passing through the second rotation shaft and being perpendicular to a straight line connecting the first rotation shaft to the second rotation shaft is located at the center of a range of deflection angle of a straight line connecting the support shaft of the other end of the linking member in the second rotating member to the second rotation shaft.

4. The mechanism according to claim 3, wherein expressions $m=L^2+r_2^2-r_1^2$ and $\theta=\sin^{-1}((r_1\times(m)^{1/2})/(r_2\times L))$ are satisfied, where L represents a distance between the first rotation shaft and the second rotation shaft, $r_1$ represents a distance between the support shaft of one end of the linking member in the first rotating member and the first rotation shaft, $r_2$ represents a distance between the support shaft of the other end of the linking member in the second rotating member and the second rotation shaft, m represents a distance between the support shaft position of one end of the linking member and the support shaft position of the other end, and $2\theta$ represents the range of deflection angle of the straight line connecting the support shaft of the other end of the linking member in the second rotating member to the second rotation shaft.

5. The mechanism according to claim 1, wherein the support shaft of one end of the linking member in the first rotating member is located at a position more inside in a radial direction of rotation of the first rotating member than the center position of a range from the first rotation shaft to the circumferential edge thereof in the radial direction of rotation.

6. The mechanism according to claim 1, wherein the support shaft of the other end of the linking member in the second rotating member is located at a position more outside in a radial direction of rotation of the second rotating member than the center position of a range from the second rotation shaft to the circumferential edge thereof in the radial direction of rotation.

7. The mechanism according to claim 1, wherein the first rotating member rotates in a bundle with a carrying member carrying the waste toner into the waste toner container.

8. The mechanism according to claim 1, further comprising a connecting portion detachably connecting the one-way clutch to the agitation paddle.

9. An image forming apparatus comprising:

a rotational driving source;

a first rotating member rotating about a first rotation shaft with a rotational driving force from the rotational driving source;

a second rotating member rotating about a second rotation shaft parallel to the first rotation shaft;

a linking member of which one end is rotatably supported at a position, which is decentered from the first rotation shaft, in the first rotating member and of which the other end is rotatably supported at a position, which is decentered from the second rotation shaft, in the second rotating member;

a waste toner container containing waste toner;

an agitation paddle agitating the waste toner recovered into the waste toner container; and a one-way clutch which is disposed between the agitation paddle and the second rotating member and which transmits a rotational driving force from the second rotating member rotating in a first rotation direction to the agitation paddle but does not transmit the rotational driving force from the second rotating member rotating in a second rotation direction opposite to the first rotation direction to the agitation paddle, wherein the support positions of the linking member in the first and second rotating members and the length of the linking member are set so that a rotation angle range of the second rotating member while the first rotating member rotates in one turn is narrower than 180°.

10. The apparatus according to claim 9, wherein conditional relations $L+r_1-r_2<m<L+r_2-r_1$ and $r_1<r_2$ are satisfied, where L represents a distance between the first rotation shaft and the second rotation shaft, $r_1$ represents a distance between the support shaft of one end of the linking member in the first rotating member and the first rotation shaft, $r_2$ represents a distance between the support shaft of the other end of the linking member in the second rotating member and the second rotation shaft, and m represents a distance between the support shaft position of one end of the linking member and the support shaft position of the other end.

11. The apparatus according to claim 9, wherein a straight line passing through the second rotation shaft and being perpendicular to a straight line connecting the first rotation shaft to the second rotation shaft is located at the center of a range of deflection angle of a straight line connecting the support shaft of the other end of the linking member in the second rotating member to the second rotation shaft.

12. The apparatus according to claim 11, wherein expressions $m=L^2+r_2^2-r_1^2$ and $\theta=\sin^{-1}((r_1\times(m)^{1/2})/(r_2\times L))$ are satisfied, where L represents a distance between the first rotation shaft and the second rotation shaft, $r_1$ represents a distance between the support shaft of one end of the linking member in the first rotating member and the first rotation shaft, $r_2$ represents a distance between the support shaft of the other end of the linking member in the second rotating member and the second rotation shaft, m represents a distance between the support shaft position of one end of the linking member and the support shaft position of the other end, and $2\theta$ represents the range of deflection angle of the straight line connecting the support shaft of the other end of the linking member in the second rotating member to the second rotation shaft.

13. The apparatus according to claim 9, wherein the support shaft of one end of the linking member in the first rotating member is located at a position more inside in a radial direction of rotation of the first rotating member than the center position of a range from the first rotation shaft to the circumferential edge thereof in the radial direction of rotation.

14. The apparatus according to claim 9, wherein the support shaft of the other end of the linking member in the second rotating member is located at a position more outside in a radial direction of rotation of the second rotating member than the center position of a range from the second rotation shaft to the circumferential edge thereof in the radial direction of rotation.

15. The apparatus according to claim 9, wherein the first rotating member rotates in a bundle with a carrying member carrying the waste toner into the waste toner container.

16. The apparatus according to claim 9, further comprising a connecting portion detachably connecting the one-way clutch to the agitation paddle.

17. The apparatus according to claim 9, wherein the rotational driving source is at least one of a motor rotationally driving a photoconductive drum, a motor rotationally driving an intermediate transfer belt unit, a motor rotationally driving a primary transfer roller, and a motor rotationally driving a secondary transfer roller.

* * * * *